US011708097B2

(12) United States Patent
Schneider et al.

(10) Patent No.: US 11,708,097 B2
(45) Date of Patent: Jul. 25, 2023

(54) HYDROMECHANICAL WHEELSET CONTROL SYSTEM FOR A RAIL VEHICLE

(71) Applicant: LIEBHERR-TRANSPORTATION SYSTEMS GMBH & CO. KG, Korneuburg (AT)

(72) Inventors: Richard Schneider, Loehningen (CH); Ivo Kovacic, Vienna (AT)

(73) Assignee: LIEBHERR-TRANSPORTATION SYSTEMS GMBH & CO. KG, Korneuburg (AT)

( * ) Notice: Subject to any disclaimer, the term of this patent is extended or adjusted under 35 U.S.C. 154(b) by 333 days.

(21) Appl. No.: 17/085,904

(22) Filed: Oct. 30, 2020

(65) Prior Publication Data

US 2021/0139057 A1 May 13, 2021

(30) Foreign Application Priority Data

Oct. 31, 2019 (DE) ..... 10 2019 129 457.6

(51) Int. Cl.
*B61F 5/38* (2006.01)

(52) U.S. Cl.
CPC ..... *B61F 5/386* (2013.01)

(58) Field of Classification Search
CPC .... B61F 5/386; B61F 5/38; B61F 5/44; B61F 5/46; B61F 9/00
See application file for complete search history.

(56) References Cited

U.S. PATENT DOCUMENTS

| | | | | |
|---|---|---|---|---|
| 2011/0315044 | A1 | 12/2011 | Maeyama et al. | |
| 2012/0048139 | A1* | 3/2012 | Okubo | B61F 5/46 105/182.1 |
| 2013/0019775 | A1* | 1/2013 | Six | B61F 5/38 105/165 |
| 2013/0312634 | A1 | 11/2013 | Smit | |
| 2014/0158015 | A1* | 6/2014 | Shimokawa | B61F 5/38 105/165 |

FOREIGN PATENT DOCUMENTS

| | | | |
|---|---|---|---|
| DE | 102013103827 | A1 | 10/2014 |
| EP | 2762377 | A1 | 8/2014 |
| FR | 2 551 412 | * | 3/1985 |
| GB | 2542639 | * | 9/2015 |
| WO | 9516597 | A1 | 6/1995 |
| WO | 2017055255 | A1 | 4/2017 |

* cited by examiner

*Primary Examiner* — Mark T Le
(74) *Attorney, Agent, or Firm* — McCoy Russell LLP

(57) ABSTRACT

A hydromechanical wheelset control system for a rail vehicle that comprises a leading wheelset and a trailing wheelset that is arranged behind the leading wheelset in the direction of locomotion, with the trailing wheelset having the property of adopting a favorable position in an arc of an undercarriage frame interacting with it and of a rail pair. The wheelset control system is characterized in that a wheelset control is provided that is connected to the leading wheelset control system and to the trailing wheelset control system and that is adapted to hydraulically deflect the leading wheelset in dependence on a deflection of the trailing wheelset, preferably by the same amount as the trailing wheelset, but in the opposite direction.

18 Claims, 3 Drawing Sheets

HYDROMECHANICAL WHEELSET CONTROL SYSTEM FOR A RAIL VEHICLE

CROSS REFERENCE TO RELATED APPLICATIONS

The present application claims priority to German Patent Application No. 10 2019 129 457.6 filed on Oct. 31, 2019. The entire contents of the above-listed application is hereby incorporated by reference for all purposes.

TECHNICAL FIELD

The present invention relates to a hydromechanical wheelset control system for a rail vehicle.

BACKGROUND AND SUMMARY

A large number of devices for controlling wheelsets in rail vehicles, from passive systems to completely active systems, are known in the prior art.

To achieve a sustainable benefit with a wheelset control of a rail vehicle, the wheelsets have to be able to be actively brought into a so-called radial position in accordance with the arc radius of the tracks, independently of the arc radius and of the contact geometry between the wheel and the rail. In the perfectly radially aligned position, the axis of the wheelset shaft extends to the center of the arc formed by the tracks. The wheelsets have to be movably arranged in the undercarriage to achieve this with wheelsets of an undercarriage arranged behind one another.

Passive or semi-passive systems that can be inexpensively implemented, but that only achieve good results at larger arc radii of the track and under ideal wheel/track conditions, are known from the prior art to align the position of wheelsets.

Active systems in contrast deliver the best results independently of the wheel/rail conditions and of the arc radii traveled over, but are considerably more expensive in their implementation. Most known active systems moreover react relatively slowly so that they cannot correctly develop their effect, above all when traveling over switches. Practically all the known active systems are furthermore not suitable for use in two-axle vehicles.

It is therefore the aim of the present invention to provide a hydromechanical wheelset control system that is considerably less expensive than a comparable active system and is thus also suitable for traveling over switches and for two-axle rail vehicles.

This is done using a hydromechanical wheelset control system.

In accordance with the invention, the hydromechanical wheelset control system for a rail vehicle comprises a leading wheelset and a trailing wheelset that is arranged behind the leading wheelset in the direction of locomotion, with the leading wheelset being adapted to vary its position in an arc of a rail pair interacting with it and/or with the trailing wheelset having the property of adopting a favorable position in an arc of an undercarriage frame interacting with it and of a rail pair. The system is characterized in that a wheelset control connected to the leading wheelset and the trailing wheelset is provided that is adapted to hydraulically deflect the leading wheelset in dependence on a deflection of the trailing wheelset, preferably by the same amount as the trailing wheelset, but in the opposite direction.

In this process, the control utilizes the circumstance that the trailing wheelset is typically guided elastically and with low stiffness in an undercarriage such that it is always practically adopted radially or overradially in the track independently of the wheel/rail conditions. The control system in accordance with the invention is therefore ideally suitable for rail vehicles at lower speeds, two-axial vehicles, and generally for rail vehicles in which lower investment costs are required for economic reasons and an active wheelset cannot be considered.

Provision is therefore made in accordance with the invention that the position of the trailing wheelset is transferred via a hydraulic control in an opposite direction to the leading wheelset so that the latter likewise adopts at least a radial or even an overradial position in the track.

The energy for the control of the leading wheelset is here delivered by the hydraulics and does not have to be taken over from the frictional energy of the trailing wheelset.

Provision is accordingly made in accordance with a further development of the invention that the trailing wheelset Is guided freely or elastically with a specific stiffness in its associated undercarriage to adopt a desired radial and/or overradial position in an arc of a rail pair under all wheel/rail conditions.

If an oversteer should be avoided or even if only a limited control is desired, the setting can be correspondingly reduced via an increase of the parallel parasitic stiffnesses (e.g. primary cushioning, additional spring, etc.) or via an additional stiffness in the hydraulic system.

Provision is made in accordance with an optional variation of the invention that the leading wheelset and the trailing wheelset are arranged in a common undercarriage frame and the position of the leading wheelset or of the trailing wheelset in an arc of a rail pair interacting with the respective wheelset is defined by a longitudinal movement between an undercarriage frame and a respective wheelset bearing.

A wheelset here comprises two wheels that are connected to one another via a common axle. Provision is made here that each of the two wheels of a wheelset rolls off on a respective rail of a rail pair so that the rail pair is in contact with a respective one wheel of a wheelset.

A pump for providing the energy for the hydraulic deflection of the leading wheelset is furthermore preferably provided, with the pump being flanged to an end of a wheelset shaft of the leading wheelset or of the trailing wheelset and being coupled to this wheelset shaft at the drive side.

The pump power required for the deflection of the leading wheelset is thereby achieved in a skillful manner directly at the wheelset shaft without the necessity of an electric cabling so that complicated cabling work can be dispensed with. A standard gear pump or axial piston pump can be considered as the pump here that is directly coupled to the wheelset shaft at the drive side. However, it is also alternatively covered by the invention that the pump for providing the required hydraulic pressure is electrically driven. The pump can here be integrated in a valve block or in a hydraulic power unit.

Provision is made accordance with an optional modification of the invention that the wheelset control system furthermore comprises at least one control valve, advantageously one control valve per wheelset, preferably a 4/3 way valve, wherein the control valve:

- is mechanically or electromechanically actuable by a deflection of the trailing wheelset to bring the control valve into a deflection position that has the result of hydraulically deflecting the leading wheelset in the opposition direction to the trailing wheelset; and
- is mechanically or electromechanically actuable by a deflection of the leading wheelset to bring the control valve into a blocking position that stops a further hydraulic deflection of the leading wheelset on reaching the desired deflection.

Provision is preferably made that the pump is switched into an idling state in the blocking position so that no power loss occurs.

Provision is made in accordance with an optional modification of the invention to design the 4/3 way valves with spring-loaded valve plungers so that the maximum throughflow amount can already be implemented with small control movements.

Provision is made in accordance with an optional modification of the invention to design an integration of all the valves present in the undercarriage as a unit in a central valve block.

The control valve is therefore actuated with reference to a position of the trailing wheelset in the track or with respect to the undercarriage frame and provides a deflection of the leading wheelset that is equal but opposite in amount.

Provision can likewise be made in accordance with the invention that the deflection of the wheelset is electrically transferred and the valve setting required from this takes place via corresponding magnetic valves.

Provision can be made in accordance with the invention that the mechanical actuation of the control valve of the respective leading wheelset for moving into a deflection position takes place via a push-pull cable. By an installation of the valve at the wheelset itself, it automatically moves into a blocking position on reaching the predefined displacement angle.

In accordance with an optional variant of the invention in which the valves are arranged at the undercarriage frame, the movement of the valve into a blocking position takes place via a second push-pull cable.

Alternatively, the actuation of the valves can also be carried out by two mutually acting simply pull cables instead of push-pull cables.

The control of the wheelsets can take place via the displacement angle of the undercarriage by attaching the push-pull cable between the railcar body and the undercarriage frame, with a corresponding stepping down of the stroke and a separation of the displacement and longitudinal movements being able to be provided.

In other words, the valve is displaced into a deflection position in that the position of the trailing wheelset on the track is changed. This is, for example, the case when traveling into a track curve since now the trailing wheelset adapts to the track curve due to its elastic guidance. This adaptation of the trailing wheelset results in a change in the switching position of the control valve from a blocking position into a deflection position in which the leading wheelset is hydraulically deflected in the opposite direction to the trailing wheelset. Once the leading wheelset reaches the deflection that is of the same amount as the trailing wheelset, the valve is moved into its blocking position. The changing of the switching positions of the valve can take place via a push-pull cable here that actuates the valve in dependence on a displacement angle of the trailing wheelset with respect to the undercarriage frame at the respective wheelset. It is, however, alternatively also covered by the invention that the changes of the switching positions can take place electromechanically or electromagnetically in dependence on a detected position of a respective wheelset in the undercarriage.

Provision can additionally be made in accordance with a variant of the invention that the mechanical actuation of the control valves takes place by means of push-pull cables that are arranged between the undercarriage frame and the railcar body so that the displacement angle of the undercarriage frame with respect to the railcar body is used as the control value.

Provision can preferably be made that at least one travel direction valve is present per wheelset, preferably a 6/2 way valve or a combination of a 4/2 way valve and a 2/2 way valve, to switch over the wheelsets from leading to trailing and vice versa that can be switched between the suction side and the pressure side of a pump coupled to a wheelset shaft by a differential pressure characterizing the direction of rotation. However, the idea is also covered by the invention that the travel direction valve is set, preferably electrically set, on the basis of travel direction information that is not acquired by the pump. This information can thus also originate from a train traffic control system or from a similar system and can result in a corresponding switching of the valve. Alternatively to the switching of the two control lines via the differential pressure, a control line can also be sufficient, with a spring actuation of the valve into the base position being provided.

This configuration proves to be advantageous when the rail vehicle changes its direction of travel. A switching position change of the travel direction valve then takes place automatically so that the previously leading wheelset now acts as a trailing wheelset and vice versa. With a pump fixedly coupled to the wheelset shaft, the switching position change takes place with reference to the pressure difference of the suction side and pressure side.

Since the position of the trailing wheelset on the track is not hydraulically influenced, the travel direction valve provides an elastic suspension of the trailing wheelset, for example in that the two chambers of an actuation cylinder of a wheelset are short circuited via a restrictor so that the trailing wheelset can adapt to an arc of a rail pair on its own.

Provision can furthermore be made in accordance with the invention that the wheelset control is provided with a dead travel to avoid unwanted control effects at higher speeds on the straights and at large arcs. Deflections of the trailing wheelset that approximately correspond to the setting of travel through an arc having a radius around 1000 m therefore preferably do not result in a control of the leading wheelset.

Provision can furthermore be made in accordance with the invention that both the trailing wheelset and the leading wheelset can be deflected via a respective at least one actuation cylinder, with the two chambers of the respective actuation cylinders being connected via a small restrictor plate so that the associated wheelset can move independently into the center position on the straight and tolerances can thus be compensated, with preferably the diameter of the restrictor plate differing in the leading wheelset and the trailing wheelset, preferably such that the leading wheelset has a higher damping than the trailing wheelset, that is the restrictor has a smaller aperture.

The restrictor plate can here be designed such that no unstable states can occur and nevertheless a practically unimpeded movement takes place during travel in arcs and switches.

Provision can furthermore be made in accordance with the invention that the chambers of the actuation cylinder of the trailing wheelset are short circuited via the travel direction valve that has an integrated restrictor plate. In this respect, the restrictor plate can have an aperture that is larger than that restrictor that is fixedly connected to the two chambers of an actuation cylinder.

Provision can furthermore be made that the travel direction valves reveal their adopted positions by different colorings of the respective valve plunger or of a valve pin that can preferably also be recognized from the outside through an inspection window. This enables the visual control of the position of the travel direction valve. If one of these valves should be blocked, different positions would be able to be recognized in both valves. A display pin is alternatively also possible that is raised or lowered via the valve plunger.

A simulation of the control principle can furthermore take place via an electronic control of the actuators so that an unexpected and disadvantageous control can be recognized.

In addition, in accordance with the invention, two actuation cylinders can be present per wheelset that engage at different sides of the wheelset in the width direction perpendicular to the travel direction.

Provision can furthermore be made in accordance with the invention that the wheelset control is configured to adapt the parallel parasitic stiffnesses (e.g. primary cushioning, additional spring, etc.) to reduce possible overradial control or only limited control of the wheelsets under track conditions with an unfavorable contact geometry or special wear conditions. This can also be generated via an additional stiffness in the hydraulic system itself.

The invention furthermore comprises an undercarriage of a rail vehicle having a hydromechanical wheelset control system in accordance with one of the variants presented above.

The invention further comprises a rail vehicle having an undercarriage such as has been introduced above.

BRIEF DESCRIPTION OF THE FIGURES

Further features, details and advantages will become visible with reference to the following description of the Figures. There are shown.

DETAILED DESCRIPTION

Figure 1:
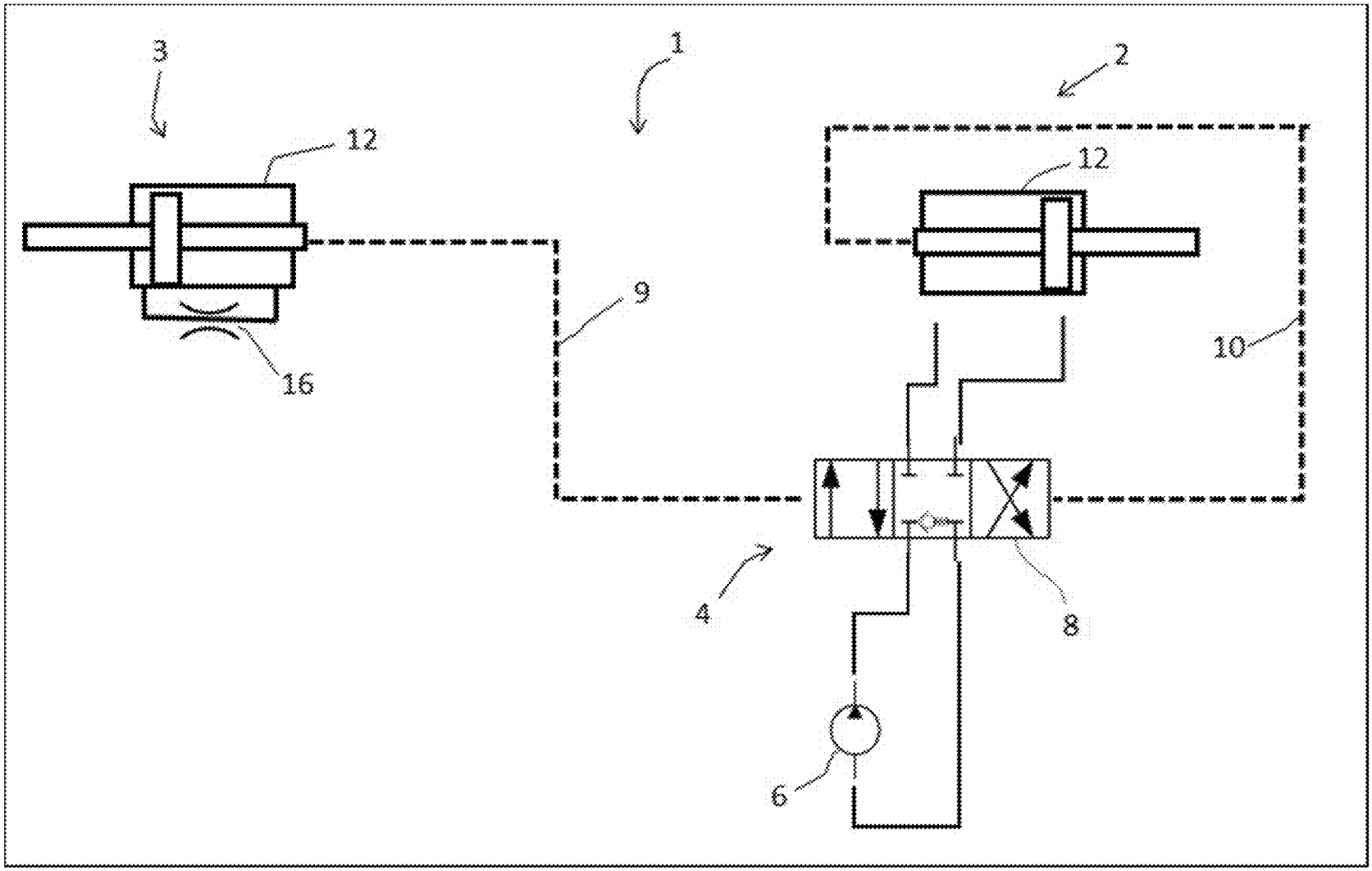
FIG. 1: a schematic representation of the present invention.

FIG. 1 shows the basic principle in accordance with the invention of a greatly simplified schematic representation.

The hydromechanical wheelset control system 1 has a leading wheelset 2 and a trailing wheelset 3 (not explicitly shown) whose position in the track can be varied by an actuation cylinder 12 associated with the wheelset 2, 3. It can be recognized that the two actuation cylinders 12 are deflected by a relatively large amount in opposite directions to one another, which indicates a track curve having a relatively small radius. A change of the actuation cylinder 12 here also always results in a change of the wheelset 2, 3. connected thereto.

It is now the idea of the invention to hydraulically adapt the leading wheelset 2 with reference to a deflection of the trailing wheelset 3 taking place automatically.

To obtain a free or elastic or adaptable trailing wheelset 3, the two chambers of the actuation cylinder 12 belonging to the trailing wheelset are short circuited via a restrictor 16. It is accordingly possible that the trailing wheelset adjusts itself in the track on the basis of an external force effect so that in a track curve the trailing wheelset previously aligned as straight adopts a desired radial position or even an overradial position.

If, however, the position of the trailing wheelset 3 or the position of the associated actuation cylinder 12 changes, this has effects on a control valve by means of a first push-pull cable 9.

This control valve, that is implemented by a 4/3 valve in FIG. 1, adopts its center position when both actuation cylinders are deflected in equal but opposite amounts.

If in contrast a change in the position of the trailing wheelset is determined via the push-pull cable 9, it is set into one of its two deflection positions. The actuation cylinder 12 of the leading wheelset therein is brought into connection with a pressurized hydraulic fluid so that the leading actuation cylinder is moved in the opposite direction to the trailing cylinder 12.

If, for example, the piston of the trailing cylinder moves to the right, the first push-pull cable has the result that the high pressure side of the hydraulic pump 6 is connected to the right chamber of the leading actuation cylinder, which brings about a position change of the leading wheelset. If the actuation cylinder is located on the oppositely disposed undercarriage side, the high pressure side of the hydraulic pump 6 is logically connected to the left chamber of the leading wheel actuation cylinder.

Only when the deflection that is equal but opposite in amount has been reached does the second push-pull cable 10 have the result that the deflection position of the control vale 8 is displaced toward the blocking position or center position of the control valve 9. In this center position of the control valve 8, the high pressure side and the lower pressure side are short circuited so that the pump 6 works in an idling state.

So that the leading actuation cylinder 12 can also carry out smaller corrections in the center position of the control valve 8, the two chambers of the actuation cylinder 12 can be connected via a restrictor 15 (not shown in FIG. 1) that permits a very much smaller throughflow than the restrictor 16.

Figure 2:
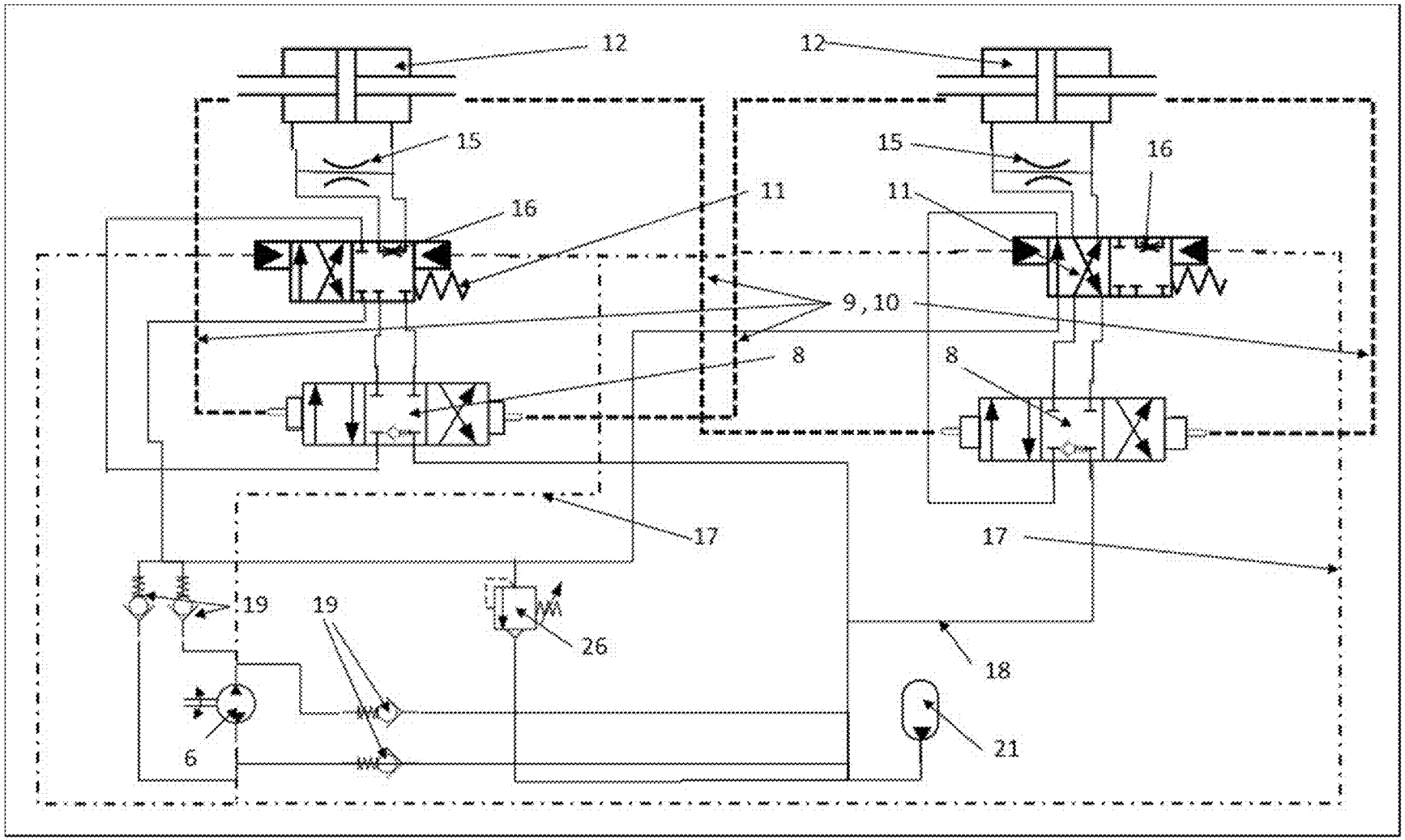
FIG. 2: a schematic representation of the hydraulic circuit diagram of the present invention that achieves the advantages in accordance with the invention independently of the travel direction.

FIG. 2 now shows a hydraulic scheme of the hydromechanical wheelset control 1, whose basic idea corresponds to the scheme of FIG. 1, for a structure independent of the travel direction that has a control valve and a travel direction valve per actuation cylinder 12.

In this respect, travel direction valves that deliver the high pressure of the pump 6 running in different directions depending on the travel direction to the leading wheelset 2 or to the associated leading actuation cylinder 12 are now present to detect the trailing and the leading wheelset. A separate control valve 8 is furthermore also present for each actuation cylinder 12, with that one of the trailing wheelset 3 being decoupled from the high pressure side of the pump 6 with the aid of the travel direction valve 11 so that any switching position changes of the trailing control valve 8 do not develop any effect.

The representation of FIG. 2 applies to an undercarriage 5 having one respective actuation cylinder 12 per wheelset 2, 3. The function here substantially corresponds to the procedure already explained with reference to FIG. 1. A pull-push cable 10 is fastened to the wheelset mounting at the respective trailing wheelset 3 and transfers the longitudinal movement between the undercarriage frame 5 and the wheelset bearing to the control valve 8, here a 4/3 way valve at the leading wheelset 2. On an actuation of the control valve 8, the actuation cylinder 12 of the leading wheelset 2 is pressurized so that it moves in the opposite direction to the trailing wheelset 3 until it reaches the same setting as that of the trailing wheelset 2. The control valve 8 is then again automatically moved into its center position in which the cylinder 8 practically hydraulically blocks and the pressure and return line is short circuited by the pump 6 so that the pump 6 no longer has to produce any pressure and practically does not generate any power loss.

The energy or the pressure for the setting is generated by a pump 6 that can be a gear pump that is fanged to the wheelset shaft end and is driven by the rotational movement of the wheelset 2, 3. The volume flow is then aligned via four check valves 19 depending on the travel direction and is forwarded to the valves 8, 11 of the cylinders 12. A relief valve 26 and a hydraulic store 21 complete the pressure supply. A closed system is produced by the use of a hydraulic store 21 that is operated in the return and at low pressure and practically no idle power is produced while idling. The check valves 19 and the hydraulic store 21 can be directly integrated at the pump 6 or also in one of the optionally present valve blocks 23. Alternatively, an open system without a pressure store, but with a simple oil sump is also conceivable.

In addition, an installation of an additional pressure store on the pressure side can be provided for a brief power increase so that suddenly occurring tight track curves such as typically occur at switches can preferably be traveled through on using the advantages of the invention due to an additionally accelerated actuation that is possible due to the additional pressure store. It is, however, naturally also possible to dimension the already present pressure store as sufficiently powerful.

The chambers of the actuation cylinder 12 of the trailing wheelset 3 are short circuited via a restrictor plate 16 via a hydraulic servo control dependent on the direction of rotation, embodied by the travel direction valve 11, here a 6/2 way valve, so that the trailing wheelset 3 can adopt its radial or overradial position in the track practically freely and without delay, but damped. In addition, the trailing wheelset 3 is decoupled from the pressure and suction side (or tank side) via the travel direction valve 11. The chambers of the actuation cylinder 12 at the trailing wheelset 2 are released by the travel direction valve 11 to the control valve 8 so that a control via the control valve 8 connected to the leading wheelset 2 is made possible. The travel direction valves 11 are actuated, for example, by the changing pressure difference at a dual-action gear pump 6 on a forward or rearward travel (direction of rotation reversal) via hydraulic control lines 17. In addition, the travel direction valves 11 are brought into a base position via springs so that no undefined positions can occur. This is specifically of advantage in a standstill of the rail vehicle when no effective pressure difference is present at the pump 6.

The wheelset control 4 can furthermore have a dead travel so that no dynamic control of the leading actuation cylinder 12 that would negatively influence the handling of the vehicle occurs at higher speeds and in large arcs of the track. This dead travel is implemented via a positive covering of the valves 8. In addition, the two chambers of each actuation cylinder 12 are connected to one another via a small restrictor plate 15 so that a very high damping of the movement is produced. This enables the wheelset 2, 3 to align itself independently in the center position on the straight and thus to compensate tolerances and errors in the settings.

Figure 3:
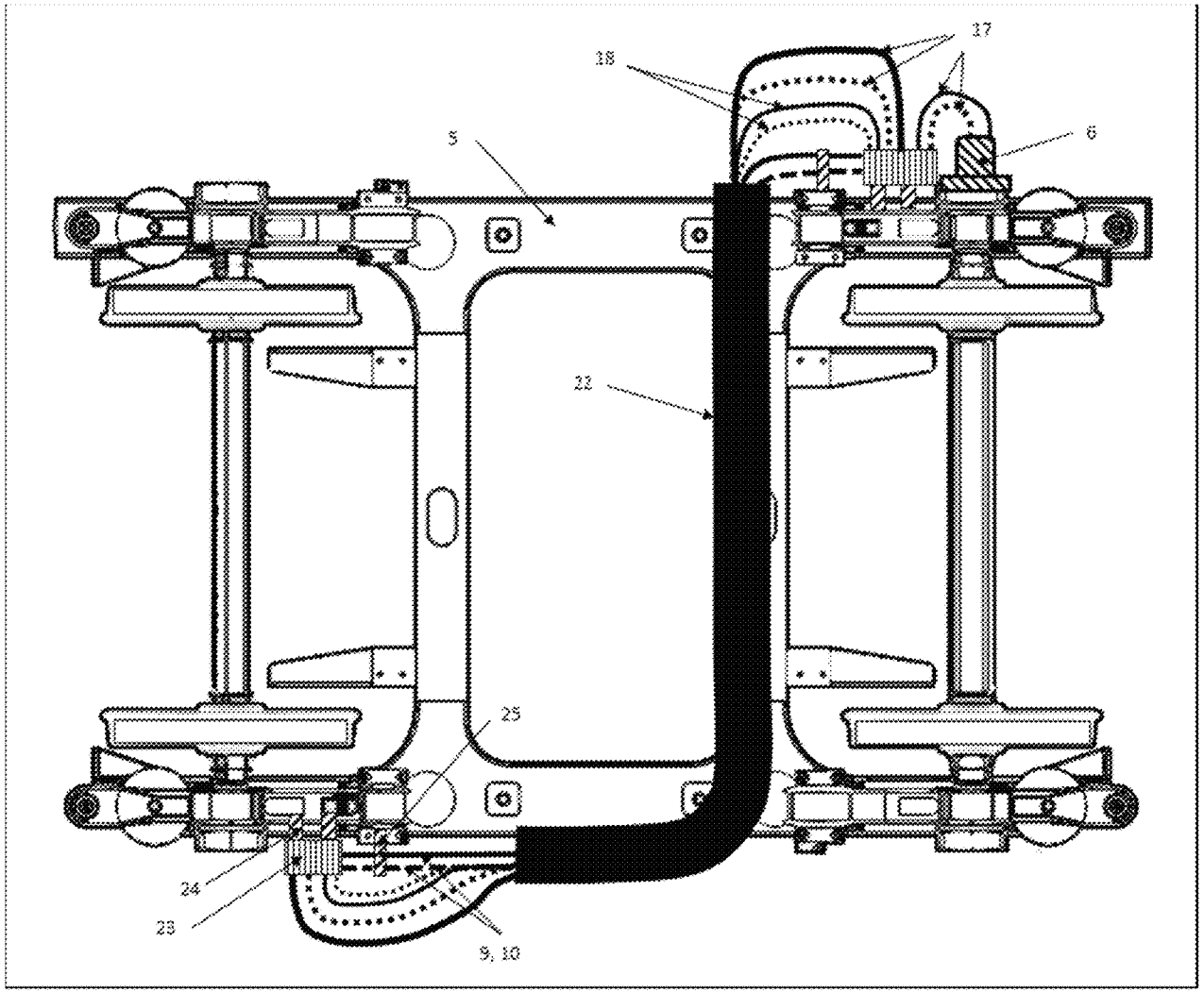
FIG. 3: a schematic plan view of an undercarriage of a railcar body frame having the wheelset control system in accordance with the invention.

As shown in FIG. 3, one respective valve block 23, comprising a control valve 8 and a travel direction valve 11, is preferably fastened to a wheelset mounting (e.g. rocker arm, wheelset bearing housing, axle guide, etc.) and is connected to the oppositely disposed wheelset mounting via two push-pull cables 9, 10. The cables 9, 10 are each fastened at alternate sides at the valve body or at the valve actuation rod. The two cables 9, 10 can be combined together with the three or our hydraulic lines 17, 18 (pressure, return, and control line(s)) in a protective tube 22 or protective pipe and are correspondingly laid in the bogie. A control system 4, comprising two valve blocks 23, two push-pull cables 9, 10, the three or four hydraulic lines 17, 18, and the pump 6, can be preassembled in this form on manufacture so that laborious setting work is no longer required on the installation at the undercarriage 5. The system 4 is thus installation and maintenance friendly.

The pump 6 and the hydraulic lines 18 starting from it are as a rule dimensioned such that high stroke speeds are achieved to reach the full deflection when traveling through switches even before the critical locations such as the frog.

Provision can be made here that the cross-sectional apertures of the valves 8 have a progressive form so that the positioning accuracy with small apertures is improved.

FIG. 3 further shows that the pump 6 can preferably be directly attached to the wheelset shaft end. There is thus no additional space requirement within the undercarriage 5 since this is anyway very tight in most cases. The check valves 19 and the hydraulic store 21 are preferably directly integrated in the valve block 23.

An approximately 6-8 times faster response time than with classical arc recognition systems—such as via the displacement angle of the undercarriage or an arc recognition sensor system (gyroscopes, accelerations, etc.)—can be achieved by the use of the trailing wheelset 3 as the control or regulation value so that the control in accordance with the invention can also produce the required high performance when traveling through switches. The power or the conveying volume of the pump 6 can be dimensioned such that the setting speed at 40 kph is sufficient to achieve the total stroke before reaching the frog of a switch.

In accordance with the invention, a state display in the form of a pressure monitoring can furthermore also be provided that either generates a display purely mechanically or takes place electronically via an LED display. The power supply of this monitoring takes place, for example, via a capacitor that is charged by the system itself via conversion of pressure changes into voltage.

In addition, an inspection window can be installed at the valve block that permits the visual monitoring of the position of the travel direction valve 11 for the travel direction change. If one of these valves should be blocked, different positions would be able to be recognized in both valves. A display pin is alternatively also possible that is raised or lowered via the valve plunger.

REFERENCE NUMERAL LIST

1 hydromechanical wheelset control system
2 leading wheelset
3 trailing wheelset
4 wheelset control
5 undercarriage/undercarriage frame
6 pump
7 wheelset shaft
8 control valve
9 first push-pull cable
10 second push-pull cable
11 travel direction valve
12 actuation cylinder

13 chamber, actuation cylinder
14 chamber, actuation cylinder
15 restrictor plate
16 restrictor plate integrated in the travel direction valve
17 differential pressure control line
18 hydraulic line
19 check valve
21 hydraulic store
22 protective tube
23 valve block
24 fastening
25 fixed point for push-pull cable
26 relief valve

The invention claimed is:

1. A hydromechanical wheelset control system for a rail vehicle, comprising:

a leading wheelset;

a trailing wheelset that is arranged in a direction of locomotion behind the leading wheelset; and a pump for providing energy for hydraulic deflection of the leading wheelset, with the pump being flanged to an end of a wheelset shaft of the leading wheelset or of the trailing wheelset and being coupled to this wheelset shaft at a drive side, wherein the leading wheelset is adapted to vary its position in an arc of a rail pair interacting with it, and wherein a wheelset control is provided that is connected to the leading wheelset and to the trailing wheelset and that is adapted to hydraulically deflect the leading wheelset in dependence on a deflection of the trailing wheelset, and the leading wheelset and the trailing wheelset are arranged in an undercarriage frame and a position of the leading wheelset or of the trailing wheelset in the arc of the rail pair interacting with the respective wheelset is defined by a longitudinal movement between the undercarriage frame and a respective wheelset bearing.

2. The wheelset control system in accordance with claim 1, wherein the trailing wheelset is guided practically freely or elastically with a specific stiffness in the undercarriage frame to adopt a desired radial and/or overradial position in the arc of the rail pair under all wheel/rail conditions.

3. The wheelset control system in accordance with claim 1, further comprising at least one control valve, wherein the control valve:

is mechanically or electromechanically actuable by the deflection of the trailing wheelset to bring the control valve into a deflection position that has a result of hydraulically deflecting the leading wheelset in an opposition direction to the trailing wheelset; and is mechanically or electromechanically actuable by the deflection of the leading wheelset to bring the control valve into a blocking position that stops a further hydraulic deflection of the leading wheelset on reaching a desired deflection; wherein the pump is switched into an idling state in the blocking position so that no power loss occurs.

4. The wheelset control system in accordance with claim 3, wherein a mechanical actuation of the control valve for moving into the deflection position takes place via a first push-pull cable and for moving into the blocking position takes place via a second push-pull cable, wherein the first push-pull cable reproduces a displacement angle of the trailing wheelset with respect to the undercarriage frame and the second push-pull cable reproduces the displacement angle of the leading wheelset with respect to the undercarriage frame.

5. The wheelset control system in accordance with claim 4, wherein the mechanical actuation of the control valves takes place by means of the push-pull cables that are arranged between the undercarriage frame and a railcar body so that a displacement angle of the undercarriage frame with respect to the railcar body is used as a control value for the railcar body.

6. The wheelset control system in accordance with claim 4, further comprising at least one travel direction valve per wheelset, for switching over the wheelsets from leading to trailing and vice versa, that is switchable by a differential pressure characterizing a direction of rotation between a suction side and a pressure side of the pump coupled to the wheelset shaft.

7. The wheelset control system in accordance with claim 1, wherein the wheelset control is provided with a dead travel to avoid unwanted control effects at higher speeds on straights and at large arcs.

8. The wheelset control system in accordance with claim 6, wherein both the trailing wheelset and the leading wheelset can be deflected via a respective actuation cylinder, with two chambers of the respective actuation cylinders being connected via a small restrictor plate so that the associated wheelset can move independently into a center position on the straight and tolerances can thus be compensated.

9. The wheelset control system in accordance with claim 8, wherein the chambers of the actuation cylinder of the trailing wheelset are short circuited via the travel direction valve that has an integrated restrictor plate.

10. The wheelset control system in accordance with claim 6, wherein an installation of the control valve and of the travel direction valve is provided pairwise at a respective wheelset mounting so that two control valves and two travel direction valves are present in leading and trailing wheelsets.

11. The wheelset control system in accordance with claim 10, wherein the travel direction valves reveal their adopted positions by different colorings of a respective valve plunger.

12. The wheelset control system in accordance with claim 6, wherein two actuation cylinders are present per wheelset that engage at different sides of the wheelset in a width direction perpendicular to the travel direction.

13. An undercarriage of a rail vehicle having a hydromechanical wheelset control system in accordance with claim 1.

14. A rail vehicle comprising an undercarriage in accordance with claim 13.

15. The hydromechanical wheelset control system for a rail vehicle according to claim 1, wherein a control wheelset is dependent on the deflection of the trailing wheelset by a same amount as the trailing wheelset, but in an opposite direction.

16. The wheelset control system according to claim 4, wherein the respective push-pull cable is coupled to an actuation cylinder of the associated wheelset.

17. The wheelset control system in accordance with claim 8, wherein a diameter of the restrictor plate differs in the leading wheelset and the trailing wheelset, such that the leading wheelset has a higher damping than the trailing wheelset.

18. The wheelset control system in accordance with claim 11, wherein a valve pin can also be recognized from outside through an inspection window.

* * * * *